US006736480B2

(12) United States Patent
Endo

(10) Patent No.: US 6,736,480 B2
(45) Date of Patent: May 18, 2004

(54) INK EJECTION DETERMINING DEVICE, INKJET PRINTER, STORAGE MEDIUM, COMPUTER SYSTEM, AND INK EJECTION DETERMINING METHOD

(75) Inventor: Hironori Endo, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/293,936

(22) Filed: Nov. 14, 2002

(65) Prior Publication Data

US 2003/0095162 A1 May 22, 2003

(30) Foreign Application Priority Data

Nov. 16, 2001 (JP) ..... 2001-352176

(51) Int. Cl.[7] ..... B41J 29/393; B41J 29/38; B41J 23/00

(52) U.S. Cl. ..... 347/19; 347/14; 347/37

(58) Field of Search ..... 347/19, 14, 5, 347/23, 7, 12, 10–11, 16, 20, 41, 51, 6, 47, 81, 37; 400/708, 709; 356/105, 103

(56) References Cited

U.S. PATENT DOCUMENTS 5,798,773 A * 8/1998 Hiramatsu et al. ..... 247/19

FOREIGN PATENT DOCUMENTS

JP 2001-113709 A 4/2001

* cited by examiner

*Primary Examiner*—Stephen D. Meier
*Assistant Examiner*—Charles Stewart, Jr.
(74) *Attorney, Agent, or Firm*—Sughrue Mion, PLLC

(57) ABSTRACT

An ink-ejection-determining device capable of determining with high reliability whether ink has been ejected is to be realized. The device comprises a light emitter capable of emitting light, and a light receptor capable of receiving the light and outputting an output signal corresponding to an amount of the light. According to a change in the output signal caused by the light being blocked by ink ejected from an ink-ejecting portion, a determination is made of whether or not ink has been ejected. If it is determined that ink has not been ejected according to the change in the output signal, after conducting a correction of a gain of the light receptor according to the output signal of the light receptor in order to make the output signal of the light receptor suit the determination of ink ejection, the determination of whether or not ink has been ejected is made again.

15 Claims, 8 Drawing Sheets

ACTUATED HEAD ARRAY AND NOZZLE NUMBER FOR EACH SCAN

| SCAN NO. | HEAD ARRAY | NOZZLE NUMBER |
|---|---|---|
| 1 (TO) | K,Lc,M | #1,#5,#9,#13,···,#173,#177 |
| 2 (FRO) | K,Lc,M | #2,#6,#10,#14,···,#174,#178 |
| 3 (TO) | K,Lc,M | #3,#7,#11,#15,···,#175,#179 |
| 4 (FRO) | K,Lc,M | #4,#8,#12,#16,···,#176,#180 |
| 5 (TO) | C,Lm,Y | #1,#5,#9,#13,···,#173,#177 |
| 6 (FRO) | C,Lm,Y | #2,#6,#10,#14,···,#174,#178 |
| 7 (TO) | C,Lm,Y | #3,#7,#11,#15,···,#175,#179 |
| 8 (FRO) | C,Lm,Y | #4,#8,#12,#16,···,#176,#180 |

INK EJECTION DETERMINING DEVICE, INKJET PRINTER, STORAGE MEDIUM, COMPUTER SYSTEM, AND INK EJECTION DETERMINING METHOD

CROSS-REFERENCE TO RELATED APPLICATIONS

The present application claims priority upon Japanese Patent Application No. 2001-352176 filed Nov. 16, 2001, which is herein incorporated by reference.

BACKGROUND OF THE INVENTION

1. Field of the Invention

The present invention relates to an ink-ejection-determining device determining whether or not ink has been ejected in a printing apparatus, an inkjet printer comprising an ink-ejection-determining device, a storage medium recording thereon a computer program that makes an ink-ejection-determining device execute ink-ejection determination, a computer system comprising the above-mentioned inkjet printer, and an ink-ejection-determining method.

2. Description of the Related Art

An inkjet printer prints images by ejecting ink from a plurality of nozzles provided in a print head. These nozzles may cause clogging due to increase in ink viscosity, mixture of bubbles, and other reasons. In this case, ink might not be ejected, and this may cause an unprinted section in an image (hereinafter, such a section will be referred to as "dot-miss"), which may result in degradation in image quality.

In order to prevent the above-mentioned dot-missing, it is effective to clean the print head. However, if the print head is cleaned, some ink, although a slight amount, will be consumed, and there is a possibility that some kind of negative influence will be exerted on the nozzles that have no problem. In view of the above, there exist ink-ejection-determining devices that optically determine whether or not ink is being ejected in order to determine, before cleaning the print head, whether or not the nozzle is actually clogged, or to determine, after cleaning, whether or not ink is being normally ejected also through the nozzle that was clogged.

FIG. 11 shows a schematic view of an example of an ink-ejection-determining device using light. This determining device comprises a light emitter 302 that emits light, and a light receptor 304 that receives the light and outputs an output signal corresponding to the amount of light.

A laser diode forming a light source of the light emitter 302 will heat-up when it emits light; and this heat may cause a decrease in laser-beam intensity. Therefore, the light emitter 302 comprises: a monitor diode (not shown) which receives the laser-beam emitted from the laser diode at a position opposite from the light receptor 304 and detects an amount of light of the received laser beam; and a controller that controls the intensity of the laser beam according to the amount of light detected by the monitor diode. The light emitter 302 thus carries out a so-called automatic power control so that the intensity of the laser beam emitted from the laser diode will be constant.

The light receptor 304 comprises a light-receiving sensor 306. Between a gain-adjusting terminal Pa of the light-receiving sensor 306 and a supply voltage Vcc, there is connected a so-called gain resistor Rg; and an output signal Vout is output from a signal-outputting terminal Pb.

Determination of whether ink has been ejected or not is made according to a change in the output level of the output signal Vout caused by blocking of the laser beam by ink Ip ejected from a print head 300 of a printing apparatus. That is, it is set so that the output signal Vout of the light-receiving sensor 306 switches between an ON level and an OFF level according to whether or not the ink Ip blocks the laser beam. In order for the output of the light-receiving sensor 306 to certainly switch between the ON level and the OFF level according to whether the ink has been ejected, it is required that the amount of light received by the light-receiving sensor 306 is stable. After the light emitter 302 is turned on, the level of the output signal in the light-receiving sensor 306 in respect to the intensity of this laser beam is adjusted using the gain resistor Rg.

However, the temperature of the monitor diode, which is provided to control the intensity of the laser beam emitted by the laser diode, may also rise with the heating-up of the laser diode, and there is a possibility that the sensitivity of the monitor diode will change. Therefore, even if the output-signal level of the light-receiving sensor 306 is adjusted in respect to the intensity of the laser-beam from the light emitter 302 after the light emitter 302 is turned on, since the temperature of the monitor diode will rise with lapse of time, a change will occur in the intensity of the laser-beam which is supposed to be controlled according to the amount of light received by this monitor diode.

Therefore, a problem arises in that, even though the output signal of the light-receiving sensor 306 is adjusted after the light emitter 302 is turned on, since the laser beam intensity will be changed at the time of determining ink ejection, the output of the light-receiving sensor 306 will not change between the ON level and the OFF level even when the ink ejected from the print head blocks the laser-beam, and it will be erroneously determined that a nozzle is clogged.

SUMMARY OF THE INVENTION

The present invention has been contrived in view of the above and other problems, and an object thereof is to realize a highly-reliable ink-ejection-determining device capable of determining whether or not ink has been ejected, an inkjet printer comprising this ink-ejection-determining device, a storage medium recording thereon a computer program that makes an ink-ejection-determining device, execute ink-ejection determination, a computer system comprising the above-mentioned inkjet printer, and an ink-ejection-determining method making it possible to determine, with a high reliability, whether or not ink has been ejected.

A main invention is an ink-ejection-determining device comprising: a light emitter capable of emitting light; and a light receptor capable of receiving the light and outputting an output signal corresponding to an amount of the light; wherein: according to a change in the output signal caused by the light being blocked by ink ejected from an ink-ejecting portion, the ink-ejection-determining device makes a determination of whether or not ink has been ejected; and if it is determined, according to the change in the output signal, that ink has not been ejected, after conducting a correction of a gain of the light receptor according to the output signal of the light receptor, the correction being conducted to make the output signal of the light receptor suit the determination of ink ejection, the ink-ejection-determining device again makes the determination of whether or not ink has been ejected.

Another main invention is an ink-ejection-determining device comprising: a light emitter capable of emitting light; and a light receptor capable of receiving the light and outputting an output signal corresponding to an amount of the light; wherein: according to a change in the output signal caused by the light being blocked by ink ejected from an ink-ejecting portion, the ink-ejection-determining device makes a determination of whether or not ink has been ejected; and if it is determined, according to the change in the output signal, that ink has not been ejected, after conducting a correction of an intensity of the light emitted by the light emitter according to the output signal of the light receptor, the correction being conducted to make the output signal of the light receptor suit the determination of ink ejection, the ink-ejection-determining device again makes the determination of whether or not ink has been ejected.

Features and objects of the present invention other than the above will become clear by reading the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
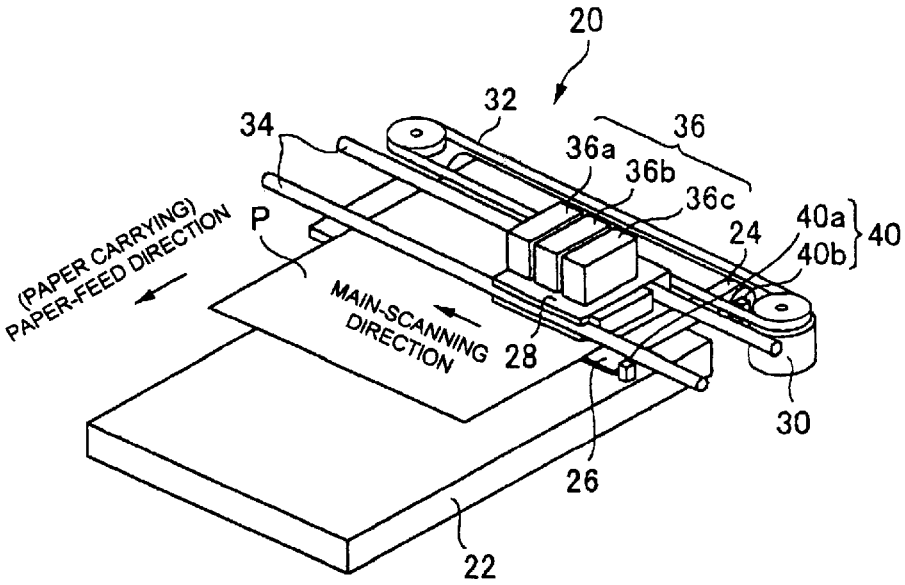
FIG. 1 is a diagram showing some main structural components of an inkjet color printer according to an embodiment of the present invention.

At least the following matters will be made clear by the explanation in the present specification and the description of the accompanying drawings.

One aspect of the present invention is an ink-ejection-determining device comprising: a light emitter capable of emitting light; and a light receptor capable of receiving the light and outputting an output signal corresponding to an amount of the light; wherein: according to a change in the output signal caused by the light being blocked by ink ejected from an ink-ejecting portion, the ink-ejection-determining device makes a determination of whether or not ink has been ejected; and if it is determined, according to the change in the output signal, that ink has not been ejected, after conducting a correction of a gain of the light receptor according to the output signal of the light receptor, the correction being conducted to make the output signal of the light receptor suit the determination of ink ejection, the ink-ejection-determining device again makes the determination of whether or not ink has been ejected.

According to this ink-ejection-detecting device, further determination of whether ink has been ejected or not is made even if it is once determined that there was no ink ejection; and upon further determination, the gain of the light receptor will be corrected according to the output signal of the light receptor. Therefore, it becomes possible to reduce occurrence of erroneous detection due to changes in light amount of the light emitter. Here, a situation in which "it is determined that ink has not been ejected according to the change in the output signal" is not limited to a case where ink is not ejected because of clogging or the like, but there may be included cases such as where, even though ink is actually being ejected, the signal output from the light receptor does not correctly change, and it is determined by the ink-ejection-determining device that ink is not ejected. For example, situations as follows may be exemplified: a case where the amount of ink ejection is small and the ink does not block the light from the light emitter sufficiently; a case where, due to some kind of reason, the ejecting direction of ink is not in the proper intended direction and the light from the light emitter is not sufficiently blocked; a case where even though the ejected ink properly blocks the light from the light emitter, the signal from the light receptor does not change from the HIGH level or the LOW level.

The light receptor may comprise a light-receiving sensor having a gain-adjusting terminal and a signal-outputting terminal, and a variable-voltage supplier connected to the gain-adjusting terminal and capable of supplying a variable voltage signal to the gain-adjusting terminal; and the correction of the gain may be conducted by detecting an output signal of the signal-outputting terminal in a state where ink is not being ejected, and adjusting a voltage of the variable-voltage signal.

According to this ink-ejection-determining device, it becomes possible to easily correct the gain of the light receptor to a gain that suits the ink-ejection determination by adjusting the voltage of the variable-voltage signal.

Further, after repeating the determination of whether or not ink has been ejected and the correction of the output signal for a predetermined number of times, and it still is determined that ink has not been ejected, if a difference between an output signal of the light receptor after conducting a further correction, and an output signal of the light receptor according to a correction conducted before determination of ink ejection just before the further correction is smaller than a predetermined value, the ink-ejection-determining device may generate a signal instructing cleaning of the ink-ejecting portion.

Accordingly, since inspection will be made of whether the gain at the time of determining ink ejection conducted right before cleaning of the ink-ejecting portion, it becomes possible to omit unnecessary cleaning operations.

Further, after repeating the determination of whether or not ink has been ejected and the correction of the output signal for a predetermined number of times, and it still is determined that ink has not been ejected, if a difference between an output signal of the light receptor after conducting a further correction, and an output signal of the light receptor according to a correction conducted before determination of ink ejection just before the further correction is larger than a predetermined value, after a lapse of a period of time from when the light emitter started to emit light until the output signal of the signal-outputting terminal becomes stable, the ink-ejection-determining device may make a further determination of ink ejection.

Accordingly, since determination of whether or not ink has been ejected will be made after the output signal stabilizes, reliability of determination results will increase.

The above-mentioned further determination of ink ejection may be made after it is detected that an amount of change in the output signal during a period of time required for making a determination of whether or not ink has been ejected, once for every the ink-ejecting portion, has become smaller than a predetermined value.

Since there is only a low possibility of occurrence of a change in light amount, which may have influence on the determination, during the period of time required for ascertaining normal operation of ink ejection, it becomes possible to obtain correct determination results.

Another aspect of the present invention is an ink-ejection-determining device comprising: a light emitter capable of emitting light; and a light receptor capable of receiving the light and outputting an output signal corresponding to an amount of the light; wherein: according to a change in the output signal caused by the light being blocked by ink ejected from an ink-ejecting portion, the ink-ejection-determining device makes a determination of whether or not ink has been ejected; and if it is determined, according to the change in the output signal, that ink has not been ejected, the ink-ejection-determining device again makes the determination of ink ejection in view of the same ink-ejecting portion, without changing a condition upon the determination except for a gain of the light receptor.

According to this device, since ink ejection will be determined in a state where all conditions, other than the gain of the light receptor, are kept the same, reliability in determination results under the same conditions, except for the gain of the light receptor, will increase.

The condition upon the determination may be any of: a relative position between the ink-ejecting portion which is to be an object of determination and the optical axis of the light; if the light is a beam of light having a convergence, a relative position between a point of the convergence and the ink-ejecting portion which is to be an object of determination; an amount of ink to be ejected from the ink-ejecting portion; intensity of light to be emitted from the light emitter; a threshold to be a reference for the determination; or a timing for making the determination.

The determination of whether or not ink has been ejected may be made while the ink-ejecting portion reciprocates in a direction intersecting the light axis of the light, and if it is determined that ink has not been ejected during movement of the ink-ejecting portion in one direction, it is preferable that a further determination of ink ejection be conducted during movement of the ink-ejecting portion in the opposite direction.

According to this ink-ejection-determining device, since the scanning direction of the ink-ejecting portion upon determination of whether or not ink has been ejected will change, it becomes possible to prevent erroneous detection of ink due to, for example, mist that may be created by scanning.

Another aspect of the present invention is an ink-ejection-determining device comprising: a light emitter capable of emitting light; and a light receptor capable of receiving the light and outputting an output signal corresponding to an amount of the light; wherein: according to a change in the output signal caused by the light being blocked by ink ejected from an ink-ejecting portion, the ink-ejection-determining device makes a determination of whether or not ink has been ejected; and if it is determined, according to the change in the output signal, that ink has not been ejected, after conducting a correction of an intensity of the light emitted by the light emitter according to the output signal of the light receptor, the correction being conducted to make the output signal of the light receptor suit the determination of ink ejection, the ink-ejection-determining device again makes the determination of whether or not ink has been ejected.

According to this ink-ejection-determining device, if it is once determined that there is no ink ejection, the intensity of light emitted by the light emitter will be corrected according to the output signal of the light receptor upon conducting, again, a determination of whether or not ink has been ejected. Therefore, it becomes possible to reduce occurrence of erroneous detection due to changes in the amount of light of the light emitter.

It is also possible to realize an inkjet printer comprising this kind of ink-ejection-determining device and/or a computer program for making the ink-ejection-determining device conduct determination of ink ejection.

Further, another aspect of the present invention is a computer system comprising: a computer; and a printer capable of being connected to the computer. The printer comprises: an ink-ejecting portion; and an ink-ejection-determining device. The ink-ejection-determining device comprises: a light emitter capable of emitting light; and a light receptor capable of receiving the light and outputting an output signal corresponding to an amount of the light, wherein: according to a change in the output signal caused by the light being blocked by ink ejected from the ink-ejecting portion, the ink-ejection-determining device makes a determination of whether or not ink has been ejected; and if it is determined, according to the change in the output signal, that ink has not been ejected, after conducting a correction of a gain of the light receptor according to the output signal of the light receptor, the correction being conducted to make the output signal of the light receptor suit the determination of ink ejection, the ink-ejection-determining device again makes the determination of whether or not ink has been ejected.

Further, another aspect of the present invention is a method of determining ink ejection comprising the steps of: according to a change in an output signal of a light receiver caused by light being blocked by ejected ink, making a determination of whether or not ink has been ejected; if it is determined that ink has not been ejected, conducting a correction of a gain of the light receptor according to the output signal of the light receptor, the correction being conducted to make the output signal of the light receptor suit the determination of ink ejection; and after conducting the correction of gain of the light receptor, again making the determination of whether or not ink has been ejected.

Further, another aspect of the present invention is a method of determining ink ejection comprising the steps of: according to a change in an output signal of a light receiver caused by light being blocked by ink ejected from an ink-ejecting portion, making a determination of whether or not ink has been ejected; and if it is determined that ink has not been ejected, again making the determination of ink ejection in view of the same ink-ejecting portion, without changing a condition upon the determination except for a gain of the light receptor.

Further, another aspect of the present invention is a method of determining ink ejection comprising the steps of: according to a change in an output signal of a light receiver caused by light emitted from a light emitter being blocked by ejected ink, making a determination of whether or not ink has been ejected; if it is determined that ink has not been ejected, conducting a correction of an intensity of the light emitted by the light emitter according to the output signal of the light receptor, the correction being conducted to make the output signal of the light receptor suit the determination of ink ejection; and after conducting the correction of the intensity of light emitted by the light emitter, again making the determination of whether or not ink has been ejected.

Schematic Structure of Printer

FIG. 1 is a schematic perspective view showing some main structural components of an inkjet color printer 20 as an example of the present invention. The printer 20 comprises: a paper stacker 22 to which printing paper P is stacked; a paper-feed roller 24 driven by a not-shown stepper motor; a platen plate 26; a carriage 28 driven in a direction (a main-scanning direction) which is parallel in view of the printing paper P and perpendicular to the paper-feed direction; a stepper motor 30 that drives the carriage 28; a timing belt that transmits power of the stepper motor 30 to the carriage 28; and guide rails 34 for guiding the carriage 28. A print head unit 36 having a multitude of nozzles that eject ink onto the printing paper P is mounted on the carriage 28.

An ink-ejection determiner 40 is provided at a standby position of the carriage 28, which is in the scanning range of the carriage 28 and on the side where the stepper motor 30 is provided. The ink-ejection determiner 40 comprises a light emitter 40*a* and a light receptor 40*b*, and determines occurrence of ink ejection by determining with light whether or not ink has been ejected. Details on determination by the ink-ejection determiner 40 will be described later.

The printing paper P is taken up from the paper stacker 22 by the paper-feed roller 24 and carried in the paper-feed direction over the surface of the platen plate 26. The carriage 28 is pulled by the timing belt 32 driven by the stepper motor 30 and moves along the guide rails 34 in the main-scanning direction. The main-scanning direction is perpendicular to the paper-feed direction.

Figure 2:
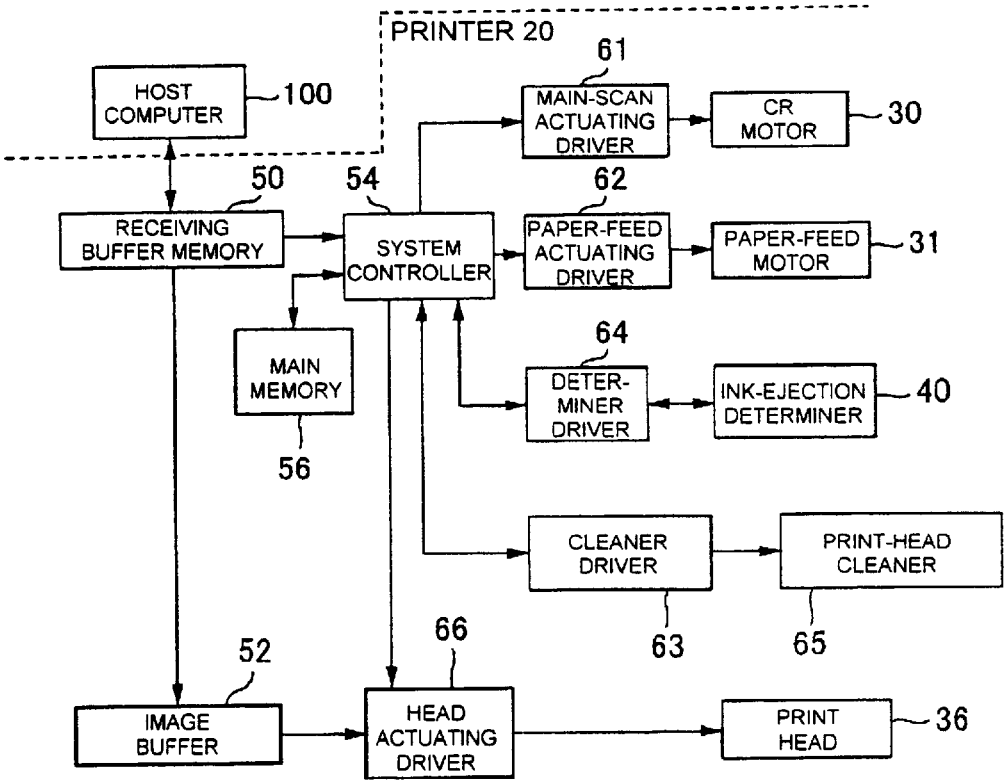
FIG. 2 is a block diagram showing electrical configuration of the inkjet color printer.

FIG. 2 is a block diagram showing an electrical configuration of the printer 20. The printer 20 comprises: a receiving buffer memory 50 that receives signals sent from a host computer 100; an image buffer 52 that stores print data; a system controller 54 that controls the overall operations of the printer 20; and a main memory 56. To the system controller 54, there are connected: a main-scan-activating driver 61 that drives the carriage motor 30; a paper-feed-activating driver 62 that drives a paper-feed motor 31; a determiner driver 64 that drives the ink-ejection determiner 40; a head-activating driver 66 that drives the print head unit 36; and a cleaner driver 63 that drives a print-head cleaner 65.

A printer driver (not shown) of the host computer 100 determines various kinds of parameter values that define printing operations according to printing modes (for example, a high-speed printing mode, a high-image-quality printing mode, and the like) designated by a user. Further, based on these parameter values, the printer driver generates print data for printing in the designated printing mode and transfers the print data to the printer 20. The transferred print data is temporarily stored in the receiving buffer memory 50. Within the printer 20, the system controller 54 reads necessary information from the print data in the receiving buffer memory 50, and according thereto, sends control signals to each of the drivers.

In the image buffer 52, there is stored print data for a plurality of color constituents obtained by resolving the print data received by the receiving buffer memory 50 into each of the color constituents. The head-activating driver 66 reads the print data for each of the color constituents from the image buffer 52 according to a control signal from the system controller 54, and according thereto, drives nozzle arrays provided in the print head unit 36 for each of the colors.

The system controller 54 realizes various functions, including an ink-ejection-determining function and a function for adjusting the ink-ejection determiner 40, by executing a computer program stored in the main memory 56.

The computer program realizing the various functions of the system controller 54 is provided in a form recorded on a computer-readable storage medium, such as a flexible disk or a CD-ROM. The host computer 100 may read the computer program from the storage medium and transfer it to the main memory 56 of the printer 20.

Note that various kinds of computer-readable media, such as a flexible disk, a CD-ROM, a magneto-optic disk, an IC card, a ROM cartridge, a punched card, a printed medium to which a code such as a barcode is printed, an inner storage device (for example, a memory such as a RAM or a ROM) of a computer, an external storage device, and the like, can be used as the "storage medium" according to the present invention.

Structure of Ink-Ejection Determiner and its Operational Principle

Figures 3, 4:
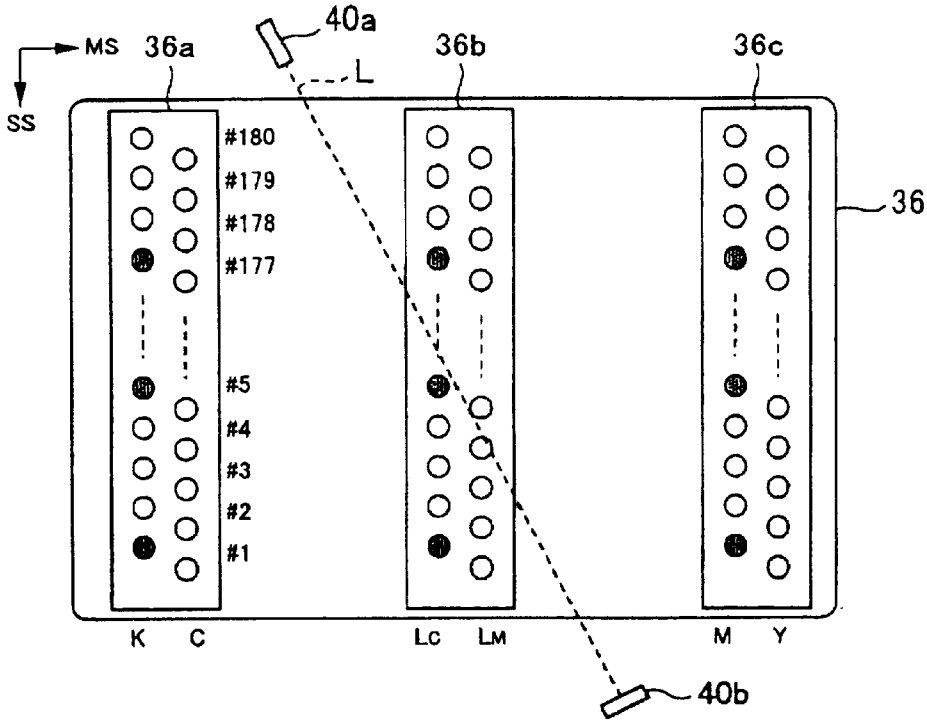
FIG. 3 is an explanatory diagram showing the configuration of the ink-ejection determiner and a principle of its determining method.
FIG. 4 is a figure showing an example of a nozzle block which is to be the object of determination for every reciprocal scan of the print head unit.

FIG. 3 is an explanatory diagram showing the structure of the ink-ejection determiner 40 and the principle of the determination method. The view is taken from the bottom side of the print head unit 36. FIG. 3 shows the print head unit 36 comprising three print heads 36*a*, 36*b*, 36*c*, and the light emitter 40*a* and the light receptor 40*b* structuring the ink-ejection determiner 40.

Nozzle arrays for a total of six colors are provided in the three print heads 36*a*, 36*b*, 36*c*. Each print head comprises nozzle arrays for two colors. The nozzle array for each color is formed of 180 nozzles (as an ink-ejecting portion).

On the bottom surface of the first print head 36*a*, there are provided a black-ink nozzle array K for ejecting black ink, and a dark-cyan-ink nozzle array C for ejecting dark-cyan ink. On the bottom surface of the second print head 36*b*, there are provided a light-cyan-ink nozzle array Lc for ejecting light-cyan ink, and a light-magenta-ink nozzle array Lm for ejecting light-magenta ink. On the bottom surface of the third print head 36*c*, there are provided a dark-magenta-ink nozzle array M for ejecting dark-magenta ink, and a yellow-ink nozzle array Y for ejecting yellow ink.

Each of the nozzles that form each nozzle array are orderly arranged parallel to the paper-feed, or sub-scanning, direction SS. Upon printing, as the print head unit 36 moves in the main-scanning direction MS along with the carriage 28 (see FIG. 1), ink is ejected from each nozzle as droplets.

The light emitter 40*a* is a laser diode that emits a beam of light having an outer diameter of approximately 1 mm or less. The direction in which the light emitter 40*a* and the light receptor 40*b* face is adjusted so that the traveling direction of the laser beam L is slightly inclined in view of the paper-feed direction SS.

Upon determining ink ejection, determination is carried out by making the print head unit 36 reciprocally move slowly in the main-scanning direction at a constant speed while emitting the laser beam L, sequentially driving the nozzles which are to be the object of determination, and ejecting ink therefrom. FIG. 4 shows an example of nozzle blocks to be the object of determination for every reciprocating scan of the print head unit 36. In this example, as the print head unit 36 reciprocates four times in the main-scanning direction, determination of ink ejection for all nozzles is completed. As shown in FIG. 4, when the print head unit 36 first moves in one direction, every four nozzles, such as the #1, #5, #9, . . . #177 nozzles, in one of the nozzle arrays (K, Lc, M) of the respective print heads 36*a*, 36*b*, 36*c* are taken as one nozzle block, and determination of ink ejection is performed for this nozzle block. If no nozzle clogging is detected, in the next returning-direction movement, a nozzle block comprised of nozzles located adjacent the former nozzle block, such as the #2, #6, #10, . . . #178 nozzles in the same nozzle array, is to be the object of detection. Therefore, when the print head unit 36 reciprocates twice, determination of ink ejection will be performed for all of the nozzles for the nozzle arrays of three colors. Similarly, during the next two reciprocations, determination of ink ejection will be performed for the remaining nozzle arrays. Determination of ink ejection will be explained in detail later.

Automatic Gain Adjustment

Figure 5:
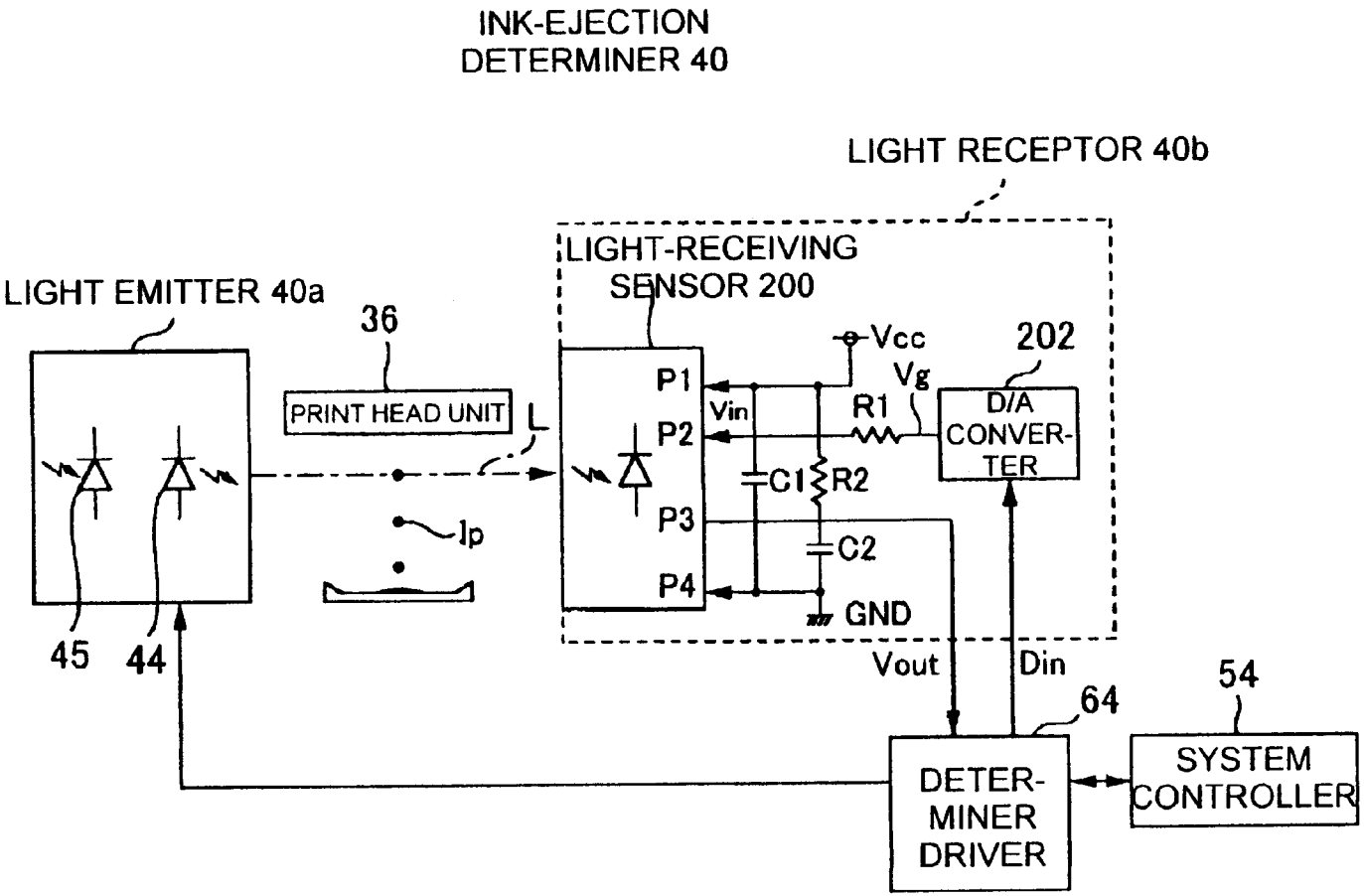
FIG. 5 is a block diagram showing an inner configuration of the ink-ejection determiner.

FIG. 5 is a block diagram showing an inner configuration of the ink-ejection determiner 40 according to the first example.

As it has been described in the Related Art, the light emitter 40*a* comprises: a laser diode 44 that forms a light source; a monitor diode 45 that receives the laser beam from the laser diode 44 and detects the amount of light; and a controller (not shown) that controls the intensity of the laser beam according to the amount of light detected by the monitor diode 45, and automatic power control is carried out.

The light receptor 40*b* comprises a light-receiving sensor 200 and a D/A converter 202. The light-receiving sensor 200 comprises: a power-source terminal P1; a gain-adjusting terminal P2; an output terminal P3; and a ground terminal P4.

The power-source terminal P1 of the light-receiving sensor 200 is connected to a supply voltage Vcc. The ground terminal P4 is connected to the a ground voltage GND. The gain-adjusting terminal P2 is connected to the D/A converter 202 through a resistor R1. A resistor R2 is connected between the output terminal P3 and the supply voltage Vcc. A capacitor C1 is connected between the power-source terminal P1 and the ground terminal P4. Another capacitor C2 is connected between the output terminal P3 and the ground terminal P4.

The determiner driver 64 supplies a digital input signal Din to the D/A converter 202. The D/A converter 202 outputs a gain-adjusting signal Vg having a voltage value corresponding to the digital input signal Din, and supplies the gain-adjusting signal Vg to the gain-adjusting terminal P2 of the light-receiving sensor 200 through the resistor R1. On the other hand, an output signal Vout output from the output terminal P3 is input to the determiner driver 64.

The system controller 54 of the printer controls the ink-ejection determiner 40 through the determiner driver 64. That is, the system controller 54 and the determiner driver 64 have the functions as a controller controlling the light emitter 40*a* and the light receptor 40*b*.

Figure 6:
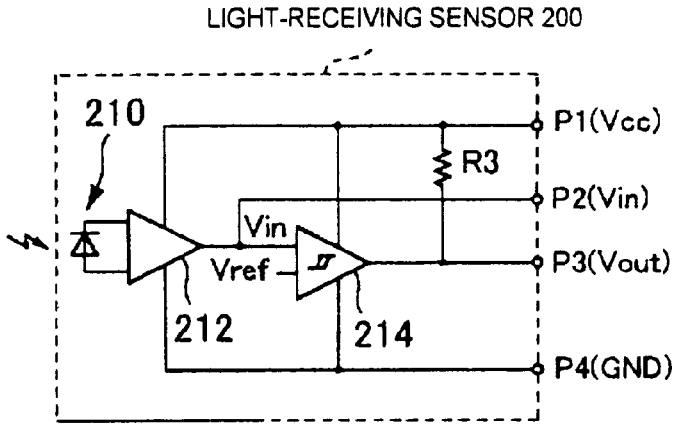
FIG. 6 is a block diagram showing an inner configuration of the light-receiving sensor.

FIG. 6 is a block diagram showing an inner configuration of the light-receiving sensor 200. The light-receiving sensor 200 comprises: a photodiode element 210; an amplifier 212; and a comparator 214. Power to the photodiode element 210 and the amplifier 212 is supplied through the power-source terminal P1 and the ground terminal P4 of the light-receiving sensor 200. To one of the two input terminals of the comparator 214, there are connected the output terminal of the amplifier 212 and the gain-adjusting terminal P2 of the light-receiving sensor 200. To the other input terminal of the comparator 214, a reference voltage Vref is supplied. An output signal of the comparator 214 is externally output through the output terminal P3 of the light-receiving sensor 200. Note that the power-source terminal P1 and the output terminal P3 are connected through a resistor R3 inside the light-receiving sensor 200.

Figure 7:
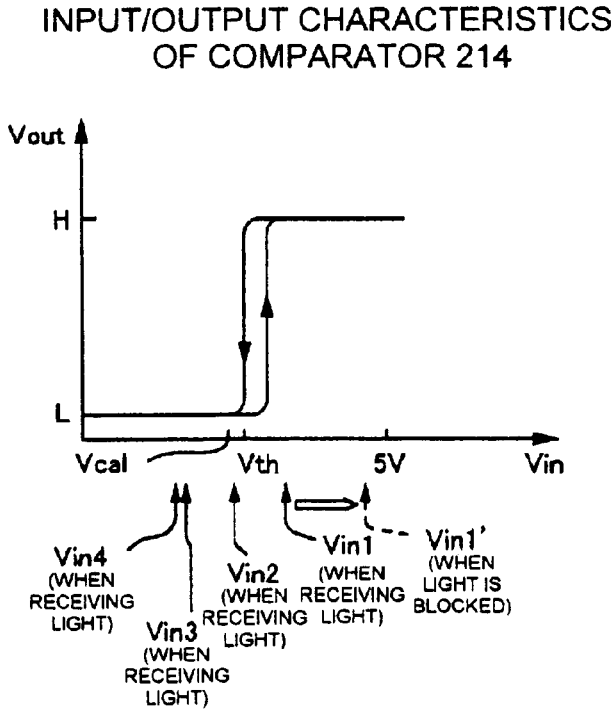
FIG. 7 is a graph showing input/output characteristics of the comparator.

FIG. 7 is a graph showing input/output characteristics of the comparator 214. This comparator 214 is a comparator exhibiting hysteresis (in other words, it is a so-called Schmitt circuit). When the input voltage Vin of the comparator 214 is decreasing, the output voltage Vout switches from level H to level L when the input voltage Vin reaches a predetermined level Vth slightly lower than the reference voltage Vref. The level Vth of the input voltage Vin at which the output voltage Vout switches from level H to level L will hereinafter be referred to as the "threshold voltage". The automatic gain adjustment explained below is carried out using the threshold voltage Vth.

Figure 8:
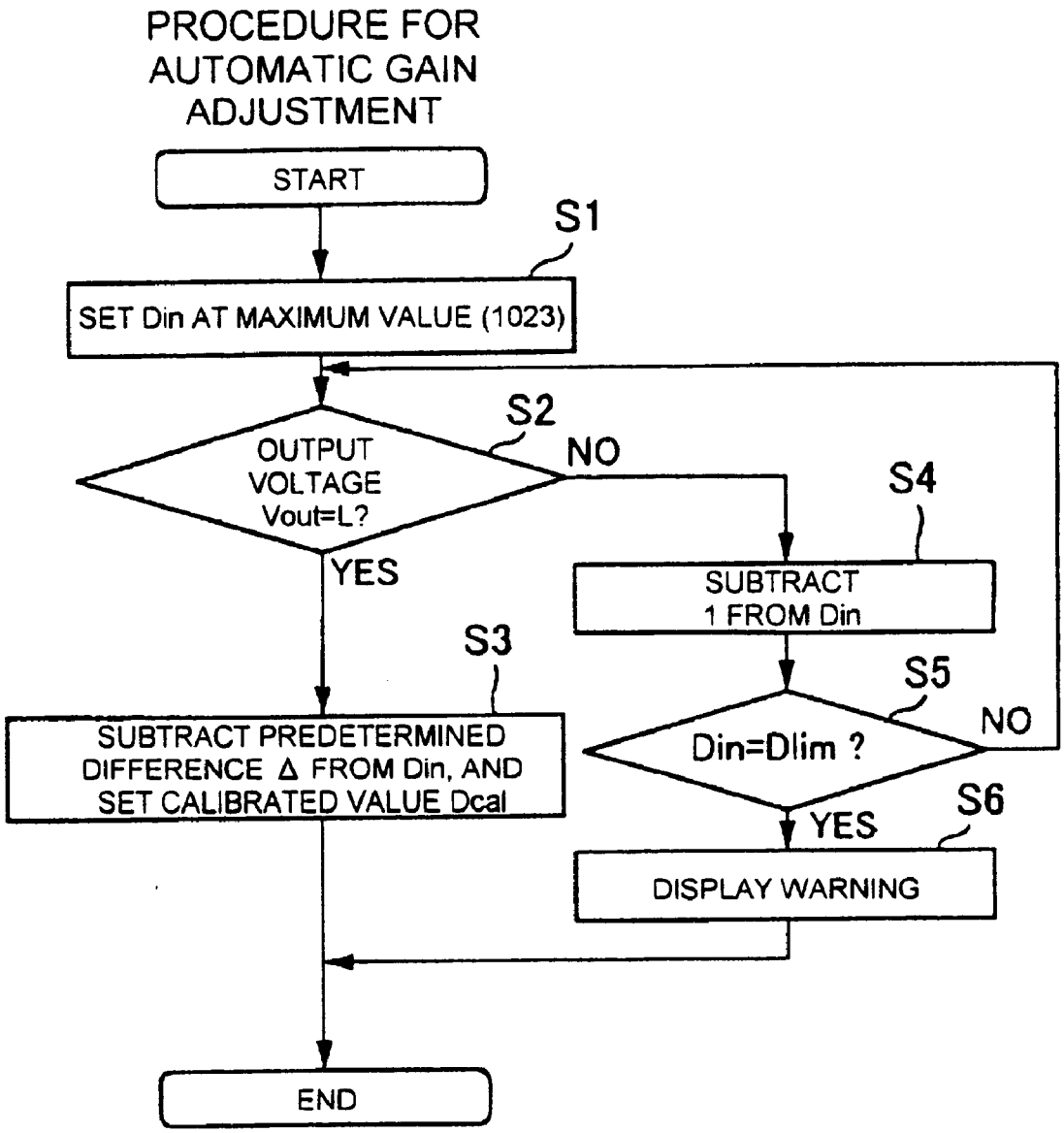
FIG. 8 is a flowchart showing procedures for automatic gain adjustment.

FIG. 8 is a flowchart showing procedures of automatic gain adjustment of the ink-ejection determiner 40. This automatic gain adjustment is realized by the system controller 54 executing a program stored in the main memory 56 (see FIG. 2) before determining ink ejection. Note that the automatic gain adjustment is carried out in a state where the light receptor 40*b* is continuously receiving the laser beam L from the light emitter 40*a* and where there is no ejection of ink Ip from the print head unit 36 (that is, in a light-receiving, no-ejection state).

At step S1, the digital input signal Din to the D/A converter 202 is set to a maximum value of a dynamic range. For example, if the digital input signal Din is a 10-bit signal, a signal indicating 1023 (in decimal) will be input. Here, for example, a gain-adjusting voltage Vg of 5 V will be output from the D/A converter 202 and input to the light-receiving sensor 200 through the resistor R1.

At step S2, it is determined whether or not the output voltage Vout of the light-receiving sensor 200 has changed to level L. As can be appreciated from the above-mentioned FIG. 7, the output voltage Vout of the comparator 214 (that is, the output voltage of the light-receiving sensor 200) will indicate level H. Therefore, at the time of step S2 which is right after starting the process shown in FIG. 8, the output voltage Vout is at level H. In this case, the procedure moves on from step S2 to step S4, and 1 (one) is subtracted from the digital input signal Din. At step S5, it is determined whether or not the decreased (subtracted) value has reached a predetermined lower limit value Dlim. If the value of the digital input signal Din has not reached the lower limit value Dlim, the procedure returns to step S2. On the other hand, if the value of the digital input signal Din has reached the lower limit value Dlim, at step S6, a warning notifying that the automatic gain adjustment has failed is displayed on a panel (not shown) of the printer and the process is ended.

The processes of steps S2, S4, and S5 are repeated until the output voltage Vout of the light-receiving sensor 200 switches from level H to level L. Note that the output voltage Vout switches from level H to level L when the input voltage Vin of the light-receiving sensor 200 reaches the threshold voltage Vth shown in FIG. 7.

When the output voltage Vout of the light-receiving sensor 200 switches to level L at step S2, step S3 is carried out. At step S3, the digital input signal Din is set to a calibrated value Dcal that is suitable for ink-ejection determination by subtracting a predetermined offset value (differential value) ΔD from the value of the digital input signal Din taken at the time when the output voltage Vout switches to level L. Determination of ink ejection is carried out in a state in which the digital input signal Din to the D/A converter 202 is maintained at the calibrated value Dcal.

FIG. 7 also shows a voltage value Vcal of the input signal Vin to the comparator 214 when a digital input signal Din having the calibrated value Dcal is input to the D/A converter 202 in the light-receiving, no-ejection state. This voltage value Vcal is set at this voltage value Vcal which is a predetermined difference lower than the threshold voltage Vth. By setting the input voltage of the comparator 214 in this way, it becomes possible to satisfactorily detect whether or not the laser beam emitted from the light emitter 40*a* is blocked by the ink Ip, as explained below.

FIG. 9 is an explanatory diagram showing a relation between the level of the input voltage Vin of the comparator 214 upon receiving light, and the detecting operation of the light-receiving sensor 200. FIG. 9A shows a result of determining ink ejection in a state where the input voltage Vin upon receiving light is set at a value Vin1 (see FIG. 7) which is higher than the threshold voltage Vth. If the laser beam is blocked by the ink Ip in this state, the input voltage Vin of the comparator 214 will rise to Vin1'. However, even at this voltage Vin1' after rising, the output voltage Vout of the light-receiving sensor 200 will be kept at level H; therefore, the ink Ip cannot be detected.

Figure 9A:
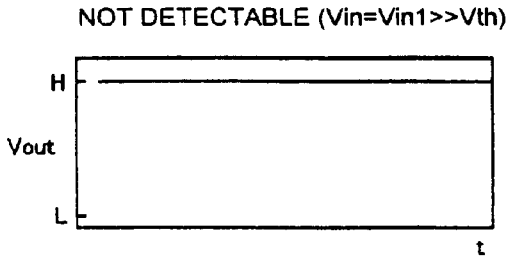
FIG. 9A is a graph showing a result of determining ink ejection in a state where the input voltage of the comparator upon receiving light is set at a value which is higher than the threshold voltage Vth.
Figure 9B:
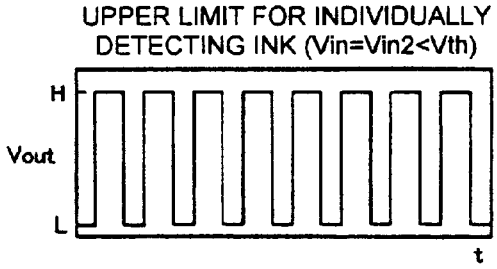
FIG. 9B is a graph showing a result of determining ink ejection in a state where the input voltage of the comparator upon receiving light is set at a value which is slightly lower than the threshold voltage Vth.

FIG. 9B shows a result of determining ink ejection in a state where the input voltage Vin of the comparator 214 upon receiving light is set at a value Vin2 (see FIG. 7) which is slightly lower than the threshold voltage Vth. If the laser beam is blocked by the ink Ip in this state, the input voltage Vin of the comparator 214 will rise; and as a result, the output voltage Vout of the light-receiving sensor 200 will switch to level L to level H. Then, when it returns to the receiving light state, the output voltage Vout will also return from level H to level L. Accordingly, as shown in FIG. 9B, when the laser beam is blocked by the ink Ip, the output voltage Vout is at level H; and when the laser beam is not blocked, the output voltage Vout is at level L. Therefore, it is possible to detect the presence of ink by checking the change between level H and level L.

The input voltage Vin2 shown in FIG. 9B is a value close to the threshold voltage Vth and is the upper limit voltage at which the ink drops can individually be detected. At this upper limit voltage Vin2, there is a possibility that ink cannot be detected well, even when there is only a slight change in measurement conditions. Therefore, it is preferable that the corrected voltage Vcal is set at a voltage lower than this upper limit voltage Vin2.

Figure 9C:
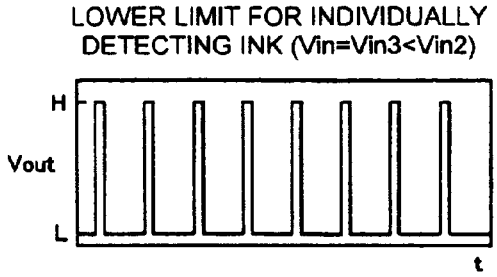
FIG. 9C is a graph showing a case in which the input voltage of the comparator upon receiving light is at a lower limit voltage at which the ink is individually detectable.

FIG. 9C shows a case in which the input voltage Vin of the comparator 214 upon receiving light is at a lower limit voltage Vin3 at which the ink is individually detectable. In this case, although the ink is individually detectable, since the period of time in which the output voltage Vout is at level H is short, there is a possibility in that a stable result cannot be obtained. Therefore, it is preferable that the corrected voltage Vcal is set above this lower limit voltage Vin3.

Figure 9D:
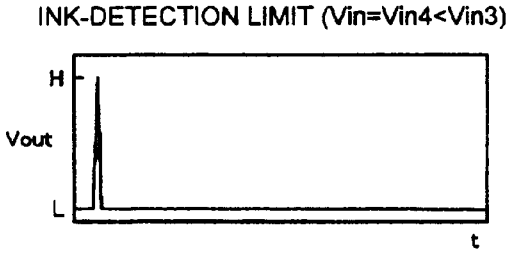
FIG. 9D is a graph showing a case in which the input voltage of the comparator upon receiving light is at a detection-limit value.

FIG. 9D shows a case in which the input voltage Vin of the comparator 214 upon receiving light is at a detection-limit value Vin4. In this case, there are situations in which the ink can or cannot be detected. Therefore, it is not possible to detect ink individually in this state.

By setting the corrected value Vcal of the input voltage Vin of the comparator 214 upon receiving light between the above-mentioned upper limit voltage Vin2 and the lower limit voltage Vin3, it becomes possible to detect ink individually and in a stable manner, even if there is a slight change in measurement conditions.

Operation of Ink-Ejection-Determining Device

Figure 10:
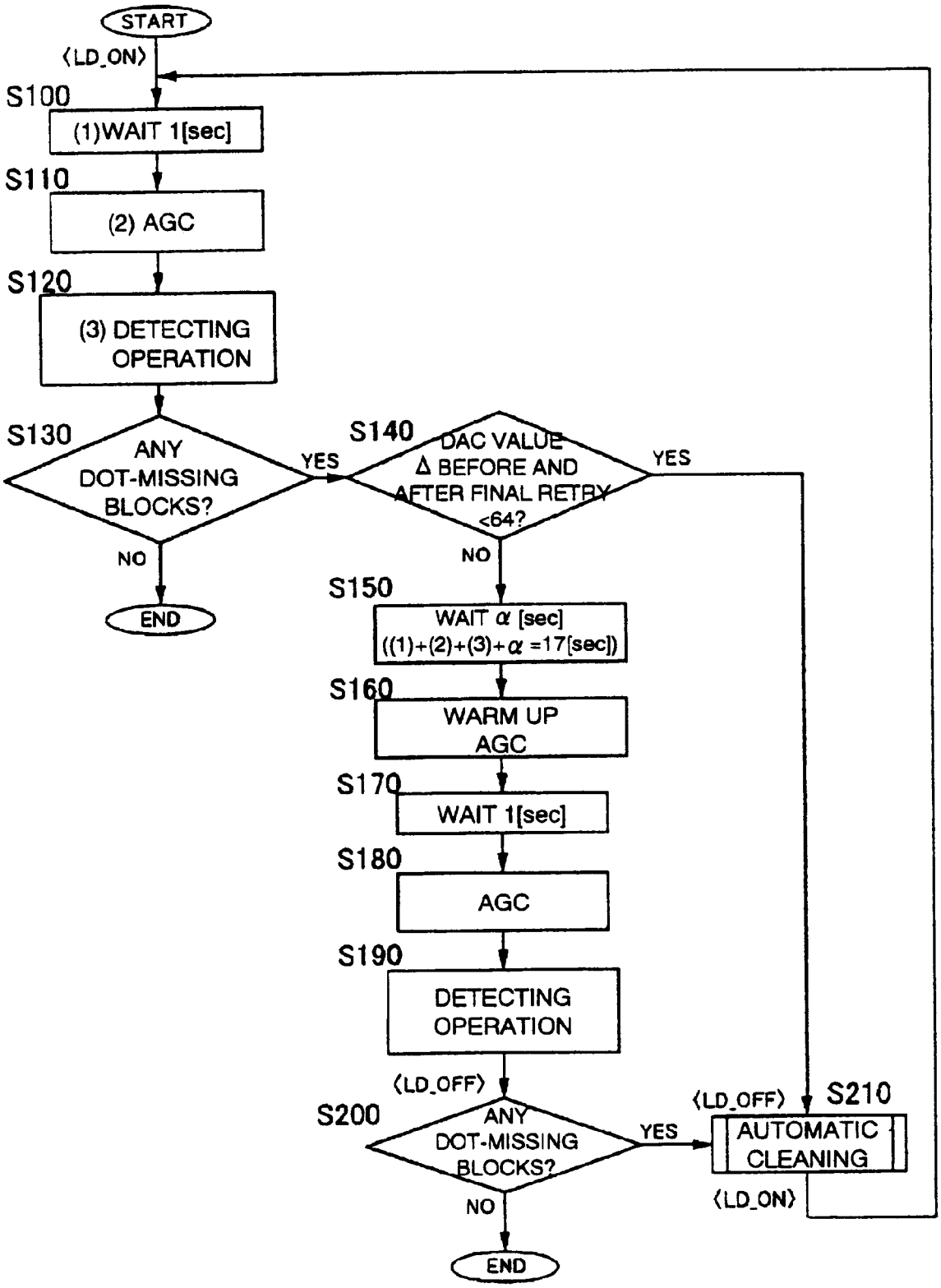
FIG. 10 is a flowchart showing an execution sequence of determining ink ejection and an accompanying automatic gain adjustment carried out by the ink-ejection-determining device.
Figure 11:
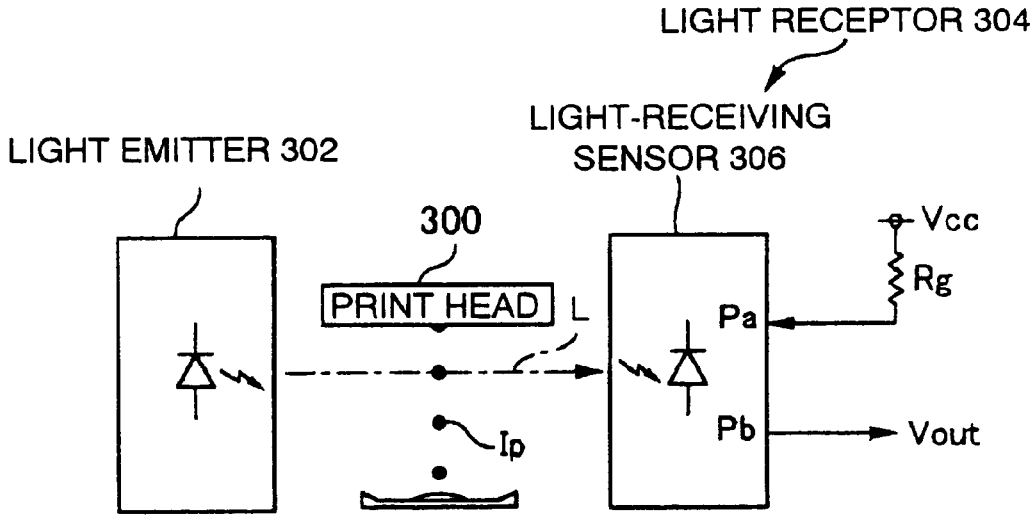
FIG. 11 is a conceptual diagram showing an example of a usual ink-ejection determining device.

FIG. 10 is a flowchart showing an execution sequence of determining ink ejection and an accompanying automatic gain adjustment carried out by the ink-ejection-determining device according to an embodiment of the present invention.

Regarding determination of ink ejection, after the laser diode 44 of the light emitter 40*a* has been turned on and waiting for approximately 1 second (S100), the above-mentioned automatic gain adjustment, or automatic gain correction (AGC), is carried out (S110). This measure is taken to omit the period in which the laser beam intensity rapidly changes upon actuating the laser diode 44 from the period for automatic gain adjustment. Then, the print head unit 36 is moved in the MS direction (see FIG. 3) in a state where the laser beam is being emitted. Here, the nozzles are made to eject ink at a timing at which the nozzles to be object of determination reach the optical axis of the laser beam.

Determination of ink ejection is carried out by making the carriage 28, which reciprocally moves in the right-and-left direction, first move or scan rightwards in the main-scanning direction while making the nozzles to be the object of determination eject ink sequentially. For example, assume a case where it is determined that ink is not being ejected upon the third move or scan, that is, upon the rightward movement of the second reciprocation. In this case, after conducting the above-mentioned automatic gain adjustment, determination of ink ejection is carried out for the second time upon the leftward movement of the second reciprocation in view of the nozzle block including the nozzle that has been determined not ejecting ink (i.e., in view of a dot-missing block). If it is determined upon the second ink-ejection determination that ink has been ejected from the nozzle that was determined not ejecting ink the first time, determination for ink ejection is continued in view of the next nozzle block to be a new object of determination. On the other hand, if it is determined again upon the second ink-ejection determination that ink has not been ejected, after carrying out the automatic gain adjustment again, the carriage 28 is scanned rightwards, and determination for ink ejection is carried out once again in view of the same nozzle block. When conducting automatic gain adjustment, the signal output of the light receptor 40*b* upon automatic gain adjustment is recorded every time automatic gain adjustment is carried out.

As explained above, if ink-ejection determination is carried out and it is determined that ink is not being ejected, after carrying out automatic gain adjustment, the carriage 28 is scanned in the opposite direction, and determination for ink ejection is repeated for a predetermined number of times, such as four times (S120). That is, determination for ink ejection is carried out four times in view of a nozzle block that has been determined not ejecting ink; and since automatic gain adjustment is carried out each time right before determination, it is possible to reduce occurrence of erroneous detection due to changes in light amount.

Assume that it is still determined that ink is not being ejected even after four times of ink-ejection determination (S130). In this case, automatic gain adjustment is carried out once again at this point of time, and then, calculation is made for a difference (hereinafter referred to as DAC value Δ) between the signal output of the light receptor 40*b* at this time and the signal output of the light receptor 40*b* at the time of automatic gain adjustment carried out right before the fourth ink-ejection determination. That is, calculation is made for the variation in light amount during the fourth ink-ejection determination (S140)

If the obtained DAC value Δ is smaller than a predetermined tolerance value of light-amount variation which will not cause erroneous detection upon ink-ejection determination, for example, if it is smaller than 64, it is estimated that the result of the fourth ink-ejection determination is not caused by a change in laser-beam intensity, but rather, ink in actually not being ejected. Therefore, the sequence proceeds to a step for carrying out head cleaning (S210).

On the other hand, if the obtained DAC value Δ is larger than 64, there is a possibility that the result of the fourth ink-ejection determination is due to a change in laser-beam intensity. Therefore, the device comes into a temporary waiting state for carrying out further ink-ejection determination (S150). Accordingly, inspection is made on the influence of the change in laser-beam intensity for the result of the fourth ink-ejection determination; and if there is a possibility that the result was caused by erroneous detection due to a change in laser-beam intensity, the print head is not cleaned. Accordingly, reliability of ink-ejection determination will enhance, and it becomes possible to prevent unnecessary head cleaning from being carried out.

The above-mentioned standby state is, for example, maintained for approximately 17 seconds from the start of laser-beam emission (S150). The above-mentioned DAC value Δ is calculated between the timing at which 17 seconds has passed and a timing approximately 4 seconds thereafter, and the obtained DAC value Δ is compared with the above-mentioned tolerance value (i.e., 64) of light-amount variation (here, AGC is in warm-up state) (S160). Here, "4 seconds" indicates a period of time required for completing ink-ejection determination in a case where, for example, when ink-ejection determination is carried out for all nozzles of the print head, ejection of ink from all of the nozzles is detected, without determining ink ejection for the same nozzle block twice. Accordingly, light-amount variation of the light receptor 40*b* taking place within the period of time required for determining ink ejection once for all of the nozzles provided in the print head unit 36 is considered to be reduced to a degree which would not have any influence on the determination result. Therefore, reliability in the following ink-ejection determination will be enhanced.

When it is ascertained that the DAC value Δ is smaller than 64 (S160), as in step S100, there is an approximately one-second standby period (S170). The total time of approximately 22 seconds, that is, 17 seconds from starting of laser-beam emission, 4 seconds for calculating the DAC value Δ, and 1 second for standby, is a period of time that the applicant has obtained empirically as a period of time from when the laser beam is emitted until the amount of light received in the light receptor 40*b* becomes stable, according to characteristics of the laser diode 44 and the monitor diode 45; and therefore, the period of time is not to be limited to the above-mentioned 17 seconds, 4 seconds, and 1 second. Further, although it is preferable that the laser beam is continuously emitted throughout the above-mentioned period, the laser beam can temporarily be turned off, if it is a short amount of time.

If the DAC value Δ obtained as above is larger than 64 (S160), a DAC value Δ is calculated every second thereafter, and the device stays in a standby mode until the value becomes smaller than 64. When it is detected that the DAC value Δ has become smaller than 64, after carrying out automatic gain adjustment (S180), the above-mentioned ink-ejection determination is again carried out for all of the nozzles (S190). If it is determined that ink has been ejected from all of the nozzles (S200), determination for ink ejection is ended. Therefore, since determination for ink ejection is carried out by a stable laser beam in which the amount of light received in the light receptor 40*b* hardly changes at the end, it becomes possible to prevent erroneous detection due to change in laser beam intensity.

On the other hand, if it is still determined that ink has not been ejected according to this ink-ejection determination, the print head unit 36 will be cleaned (S210).

As explained above, by repeating automatic gain adjustment and ink-ejection determination for nozzle blocks including nozzles that are determined not ejecting ink, it becomes possible to enhance the precision of ink-ejection determination. Accordingly, cleaning will be carried out only if there actually is a nozzle that is not ejecting ink; therefore, it becomes possible to omit unnecessary cleaning operations and prevent unwanted consumption of ink.

In the above-mentioned ink-ejection determination, it is preferable to carry out determination without changing any of the conditions, except for the gain of the light receptor, until the above-mentioned series of operations for determination is completed. Here, the above-mentioned "conditions" may be, for example: a relative position between the ink-ejecting portion which is to be an object of determination and the optical axis of the light; if the light is a beam of light having a convergence, a relative position between a position of the convergence and the ink-ejecting portion which is to be an object of determination; an amount of ink to be ejected from the ink-ejecting portion; intensity of light to be emitted from the light emitter; a threshold to be a reference for determination; or a timing for carrying out the determination.

In the above-mentioned embodiment, explanation was made of a method for correcting the gain of the light receptor to a suitable value in order to make the output signal of the light receptor suit ink-ejection determination. However, it is possible to correct the intensity of the light that the light emitter emits so that the output signal of the light receptor suits ink-ejection determination. In the latter case, the output signal of the light receptor will be monitored and the intensity of the light emitted from the light emitter will be controlled in order to make the output signal of the light receptor suitable.

Others

Explanation has been made of an ink-ejection-determining device etc. of the present invention according to several embodiments. However, the above-mentioned embodiments of the present invention have only been given to facilitate understanding of the present invention, and are not to limit the present invention. It is without saying that the present invention may be altered and/or modified without departing from the scope thereof, and that the present invention includes its equivalents.

Further, although printing paper was explained as an example of a printing medium, it is also possible to use, for example, a film, cloth, a thin metal sheet, or the like, as the printing medium.

It is also possible to realize a computer system comprising, for example: the printer according to the above-mentioned embodiment; a computer; a display device such as a CRT; an input device such as a mouse or a keyboard; a flexible-disk drive device; and a CD-ROM drive device. In a computer system realized as above, the system, as a whole, will be superior to a usual system.

It is also possible to make the printer according to the above-mentioned embodiment have some of the functions or mechanisms respectively possessed by the computer, the display device, the input device, the flexible-disk drive device, and the CD-ROM drive device. For example, the structure may be that the printer has an image processor for processing an image, a displaying unit for various kinds of displaying, and a recording-media attaching/detaching portion for attaching/detaching a recording medium on which image data taken by, for example, a digital camera is recorded.

In the above-mentioned embodiment, an example in which the ink-ejection-determining device is provided on an inkjet color printer was explained; however, the apparatus is not to be limited to the above as long as it is an apparatus that can print on a printing medium. For example, the ink-ejection-determining device can be applied to, for example, a single-color inkjet printer, a facsimile machine, a copying machine comprising reading means, and the like.

According to the present invention, it is possible to realize a highly-reliable ink-ejection-determining device capable of determining whether or not ink has been ejected, an inkjet printer comprising an ink-ejection-determining device, a storage medium recording thereon a computer program that makes an ink-ejection-determining device execute ink-ejection determination, a computer system comprising the above-mentioned inkjet printer, and an ink-ejection-determining method making it possible to determine, with a high reliability, whether or not ink has been ejected.

What is claimed is:

1. An ink-ejection-determining device comprising:

a light emitter capable of emitting light; and a light receptor capable of receiving said light and outputting an output signal corresponding to an amount of said light;

wherein:

according to a change in said output signal caused by said light being blocked by ink ejected from an ink-ejecting portion, said ink-ejection-determining device makes a determination of whether or not ink has been ejected; and if it is determined, according to said change in said output signal, that ink has not been ejected, after conducting a correction of a gain of said light receptor according to said output signal of said light receptor, said correction being conducted to make said output signal of said light receptor suit said determination of ink ejection, said ink-ejection-determining device again makes said determination of whether or not ink has been ejected.

2. An ink-ejection-determining device according to claim 1, wherein:

said light receptor comprises a light-receiving sensor having a gain-adjusting terminal and a signal-outputting terminal, and a variable-voltage supplier connected to said gain-adjusting terminal and capable of supplying a variable voltage signal to said gain-adjusting terminal; and said correction of said gain is conducted by detecting an output signal of said signal-outputting terminal in a state where ink is not being ejected, and adjusting a voltage of said variable-voltage signal.

3. An ink-ejection-determining device according to claim 2, wherein:

after repeating said determination of whether or not ink has been ejected and said correction of said output signal for a predetermined number of times, and it still is determined that ink has not been ejected, if a difference between an output signal of said light receptor after conducting a further correction, and an output signal of said light receptor according to a correction conducted before determination of ink ejection just before said further correction is smaller than a predetermined value, said ink-ejection-determining device generates a signal instructing cleaning of said ink-ejecting portion.

4. An ink-ejection-determining device according to claim 2, wherein:

after repeating said determination of whether or not ink has been ejected and said correction of said output signal for a predetermined number of times, and it still is determined that ink has not been ejected, if a difference between an output signal of said light receptor after conducting a further correction, and an output signal of said light receptor according to a correction conducted before determination of ink ejection just before said further correction is larger than a predetermined value, after a lapse of a period of time from when said light emitter started to emit light until said output signal of said signal-outputting terminal becomes stable, said ink-ejection-determining device makes a further determination of ink ejection.

5. An ink-ejection-detecting device according to claim 4, wherein, said further determination of ink ejection is made after it is detected that an amount of change in said output signal during a period of time required for making a determination of whether or not ink has been ejected, once for every said ink-ejecting portion, has become smaller than a predetermined value.

6. An ink-ejection-determining device comprising:

a light emitter capable of emitting light; and a light receptor capable of receiving said light and outputting an output signal corresponding to an amount of said light;

wherein:

according to a change in said output signal caused by said light being blocked by ink ejected from an ink-ejecting portion, said ink-ejection-determining device makes a determination of whether or not ink has been ejected; and if it is determined, according to said change in said output signal, that ink has not been ejected, said ink-ejection-determining device again makes said determination of ink ejection in view of the same ink-ejecting portion, without changing a condition upon said determination except for again of said light receptor.

7. An ink-ejection-determining device according to claim 6, wherein said condition upon said determination is any of:

a relative position between said ink-ejecting portion which is to be an object of determination and the optical axis of said light;

if said light is a beam of light having a convergence, a relative position between a point of said convergence and said ink-ejecting portion which is to be an object of determination;

an amount of ink to be ejected from said ink-ejecting portion;

intensity of light to be emitted from said light emitter;

a threshold to be a reference for said determination; or a timing for making said determination.

8. An ink-ejection-determining device according to claim 6, wherein, said determination of whether or not ink has been ejected is made while said ink-ejecting portion reciprocates in a direction intersecting said light axis of said light, and if it is determined that ink has not been ejected during movement of said ink-ejecting portion in one direction, a further determination of ink ejection will be conducted during movement of said ink-ejecting portion in the opposite direction.

9. An ink-ejection-determining device comprising:

a light emitter capable of emitting light; and a light receptor capable of receiving said light and outputting an output signal corresponding to an amount of said light;

wherein:

according to a change in said output signal caused by said light being blocked by ink ejected from an ink-ejecting portion, said ink-ejection-determining device makes a determination of whether or not ink has been ejected; and if it is determined, according to said change in said output signal, that ink has not been ejected, after conducting a correction of an intensity of said light emitted by said light emitter according to said output signal of said light receptor, said correction being conducted to make said output signal of said light receptor suit said determination of ink ejection, said ink-ejection-determining device again makes said determination of whether or not ink has been ejected.

10. An inkjet printer comprising:

an ink-ejecting portion; and an ink-ejection-determining device, said ink-ejection-determining device comprising:

a light emitter capable of emitting light; and a light receptor capable of receiving said light and outputting an output signal corresponding to an amount of said light;

wherein:

according to a change in said output signal caused by said light being blocked by ink ejected from said ink-ejecting portion, said ink-ejection-determining device makes a determination of whether or not ink has been ejected; and if it is determined, according to said change in said output signal, that ink has not been ejected, after conducting a correction of a gain of said light receptor according to said output signal of said light receptor, said correction being conducted to make said output signal of said light receptor suit said determination of ink ejection, said ink-ejection-determining device again makes said determination of whether or not ink has been ejected.

11. A storage medium having a program recorded thereon, said program capable of making an ink-ejection-determining device, comprising a light emitter capable of emitting light and a light receptor capable of receiving said light and outputting an output signal corresponding to an amount of said light, operate, said program making said ink-ejection-determining device realize the following steps of:

according to a change in said output signal caused by said light being blocked by ink ejected from an ink-ejecting portion, making a determination of whether or not ink has been ejected; and if it is determined, according to said change in said output signal, that ink has not been ejected, after conducting a correction of a gain of said light receptor according to said output signal of said light receptor, said correction being conducted to make said output signal of said light receptor suit said determination of ink ejection, again making said determination of whether or not ink has been ejected.

12. A computer system comprising:

a computer; and a printer capable of being connected to said computer, said printer comprising:

an ink-ejecting portion; and an ink-ejection-determining device, said ink-ejection-determining device comprising:

a light emitter capable of emitting light; and a light receptor capable of receiving said light and outputting an output signal corresponding to an amount of said light, wherein:

according to a change in said output signal caused by said light being blocked by ink ejected from said ink-ejecting portion, said ink-ejection-determining device makes a determination of whether or not ink has been ejected; and if it is determined, according to said change in said output signal, that ink has not been ejected, after conducting a correction of a gain of said light receptor according to said output signal of said light receptor, said correction being conducted to make said output signal of said light receptor suit said determination of ink ejection, said ink-ejection-determining device again makes said determination of whether or not ink has been ejected.

13. A method of determining ink ejection comprising the steps of:

according to a change in an output signal of a light receiver caused by light being blocked by ejected ink, making a determination of whether or not ink has been ejected;

if it is determined that ink has not been ejected, conducting a correction of a gain of said light receptor according to said output signal of said light receptor, said correction being conducted to make said output signal of said light receptor suit said determination of ink ejection; and after conducting said correction of gain of said light receptor, again making said determination of whether or not ink has been ejected.

14. A method of determining ink ejection comprising the steps of:

according to a change in an output signal of a light receiver caused by light being blocked by ink ejected from an ink-ejecting portion, making a determination of whether or not ink has been ejected; and if it is determined that ink has not been ejected, again making said determination of ink ejection in view of the same ink-ejecting portion, without changing a condition upon said determination except for a gain of said light receptor.

15. A method of determining ink ejection comprising the steps of:

according to a change in an output signal of a light receiver caused by light emitted from a light emitter being blocked by ejected ink, making a determination of whether or not ink has been ejected;

if it is determined that ink has not been ejected, conducting a correction of an intensity of said light emitted by said light emitter according to said output signal of said light receptor, said correction being conducted to make said output signal of said light receptor suit said determination of ink ejection; and after conducting said correction of said intensity of light emitted by said light emitter, again making said determination of whether or not ink has been ejected.

* * * * *